US005851071A

United States Patent [19]

Arnell

[11] Patent Number: 5,851,071

[45] Date of Patent: Dec. 22, 1998

[54] PLASTIC BAG WITH PERMANENT SEALING ZIPPER

[75] Inventor: Pat Arnell, Calgary, Canada

[73] Assignee: Rayton Packaging, Inc., Calgary, Canada

[21] Appl. No.: 927,072

[22] Filed: Sep. 11, 1997

[51] Int. Cl.[6] ..... B65D 33/24; B65D 33/34

[52] U.S. Cl. ..... 383/63; 383/9; 383/61; 383/67; 383/209; 383/5

[58] Field of Search ..... 383/5, 9, 61, 63, 383/207, 208, 209, 41, 67

[56] References Cited

U.S. PATENT DOCUMENTS

| | | |
|---|---|---|
| 2,871,539 | 2/1959 | Swan . |
| 3,440,696 | 4/1969 | Staller . |
| 4,691,373 | 9/1987 | Ausnit . |
| 4,858,286 | 8/1989 | Siegel . |
| 4,878,763 | 11/1989 | Ausnit . |
| 4,923,701 | 5/1990 | VanErden . |
| 4,944,072 | 7/1990 | Robson . |
| 5,188,461 | 2/1993 | Sorensen . |
| 5,235,731 | 8/1993 | Anzai et al. . |
| 5,272,794 | 12/1993 | Hamstani et al. . |
| 5,276,950 | 1/1994 | Johnson . |
| 5,372,428 | 12/1994 | Bruno et al. . |
| 5,435,864 | 7/1995 | Machacek et al. . |
| 5,509,734 | 4/1996 | Ausnit . |
| 5,511,884 | 4/1996 | Bruno et al. . |
| 5,566,429 | 10/1996 | Martinez et al. . |
| 5,588,187 | 12/1996 | Swain . |
| 5,618,111 | 4/1997 | Porchia et al. . |

*Primary Examiner*—Jes F. Pascua
*Attorney, Agent, or Firm*—Sheldon & Mak

[57] ABSTRACT

A plastic bag is provided which allows for the bottom loading of the plastic bag and subsequent sealing of the bottom edges of the plastic bag without the use of tools, adhesives or tapes. In the invention, the plastic bag includes a one-time plastic zipper mechanism disposed at the bottom edges which provides a one-time, permanent seal to the bottom edges of the bag. The seal is such that it cannot be unsealed without discernable damage to the bag.

11 Claims, 2 Drawing Sheets

PLASTIC BAG WITH PERMANENT SEALING ZIPPER

FIELD OF THE INVENTION

This invention relates generally to plastic bags and, more specifically, to plastic bags having zipper openings.

BACKGROUND

Plastic bags having plastic "zipper" openings have had enormous popularity over the last 20 years. Such plastic bags can be repeatedly unsealed and resealed without the necessity of tools and without extraneous devices (such as twist ties, tape, etc.).

A problem arises, however, in the use of such zippered plastic bags in the packaging of fruits and vegetables for retail sales. It is now generally considered prudent, and in many communities, legally required, to package fruits and vegetables in a way that the consumer can quickly recognize whether or not the contents of the package have been tampered with. This is not generally possible with typical zippered plastic bags of the prior art. The very characteristic of the plastic zipper which allows ease of unsealing and resealing the bag, makes it impossible to detect whether or not the contents of the bag have been tampered with.

In an attempt to overcome this problem, packagers of fruits and vegetables use zippered plastic bags wherein the zippered end is sealed by a one-time sealing mechanism, such as a perforated line. A consumer can quickly recognize whether or not such a plastic bag has been tampered with by whether or not the one-time seal has been broken.

The problem with the use of such plastic bags having a one-time seal across the zippered end has been how to conveniently and efficiently seal the fruits or vegetables into the plastic bag.

At the present time, the state-of-the-art is to load such plastic bags through a bottom opening and then seal the bottom opening using heat sealing devices, adhesives or plastic tape. All such presently known sealing methods, however, have their drawbacks. Heat sealing equipment is expensive, slow, cumbersome and difficult to use in the field. Adhesives and plastic tapes have the additional disadvantage of being difficult to keep clean when packaging is conducted in dusty environments, such as outdoors or in warehouses. Moreover, bags sealed with adhesives and, especially plastic tapes, frequently have an untidy appearance.

Accordingly, there is a need for a plastic bag which will solve the aforementioned problems in an efficient and inexpensive manner.

SUMMARY

The invention satisfies this need. The invention is a plastic bag comprising: (a) a front wall and a rear wall, both walls being comprised of a flexible thermoplastic material and having a top edge, a bottom edge, a first side edge and an opposed second side edge, the first side edge of the front wall being attached to the first side edge of the rear wall and the second side edge of the front wall being attached to the second side edge of the rear wall so that the front wall and the rear wall are disposed opposite to one another and cooperate to define an interior bag compartment; (b) a plastic top zipper disposed along the top edges of the front and rear walls so as to alternatively seal and unseal the top edges of the front and rear walls; (c) a first longitudinal groove disposed proximate to the bottom edge of either the front wall or the rear wall, the first longitudinal groove being disposed so as to face the opposite wall; and (d) a first longitudinal tongue disposed proximate to the bottom edge of the wall opposite the wall having the longitudinal groove, the first longitudinal tongue being disposed, sized and dimensioned to mate with the first longitudinal groove in such a way that the bottom edges of the front and rear walls can be permanently sealed.

By the term "permanently sealed," it is meant that the bag cannot be opened at the bottom edges without damaging the bottom edges in a way which would be readily apparent to the consumer—at least without use of special equipment.

Typically, the top edges of the bag are sealed in a way that they can be manually unsealed without tools, such as by use of a perforated line.

In a preferred embodiment of the invention, the first longitudinal tongue has a bulbous upper portion and the longitudinal groove has a corresponding expanded lower portion.

In a more preferred embodiment of the invention, the plastic bag further comprises: (a) a second longitudinal groove disposed proximate to the bottom edge of the wall having the first longitudinal tongue and disposed in parallel with the first longitudinal tongue; and (b) a second longitudinal tongue disposed proximate to the bottom edge of the wall having the first longitudinal groove and disposed in parallel with the first longitudinal groove, the second longitudinal tongue being disposed, sized and dimensioned to mate with the second longitudinal groove. Like the first longitudinal tongue and longitudinal groove, the second longitudinal tongue has a bulbous upper portion and the second longitudinal has an expanded lower portion.

It is still further preferred that both longitudinal tongues have opposed barb edges which mate with corresponding barb receiving spaces within the longitudinal grooves.

The invention has been found to provide an efficient method of packaging fruits or vegetables in bags which cannot be tampered with without alerting the consumer to that fact. The invention is conveniently used, even in dusty packaging locations, and always provides a tidy and aesthetically pleasing appearance.

DRAWINGS

These features, aspects and advantages of the present invention will become better understood with regard to the following description, appended claims and accompanying figures where:

DESCRIPTION OF THE INVENTION

Figure 1:
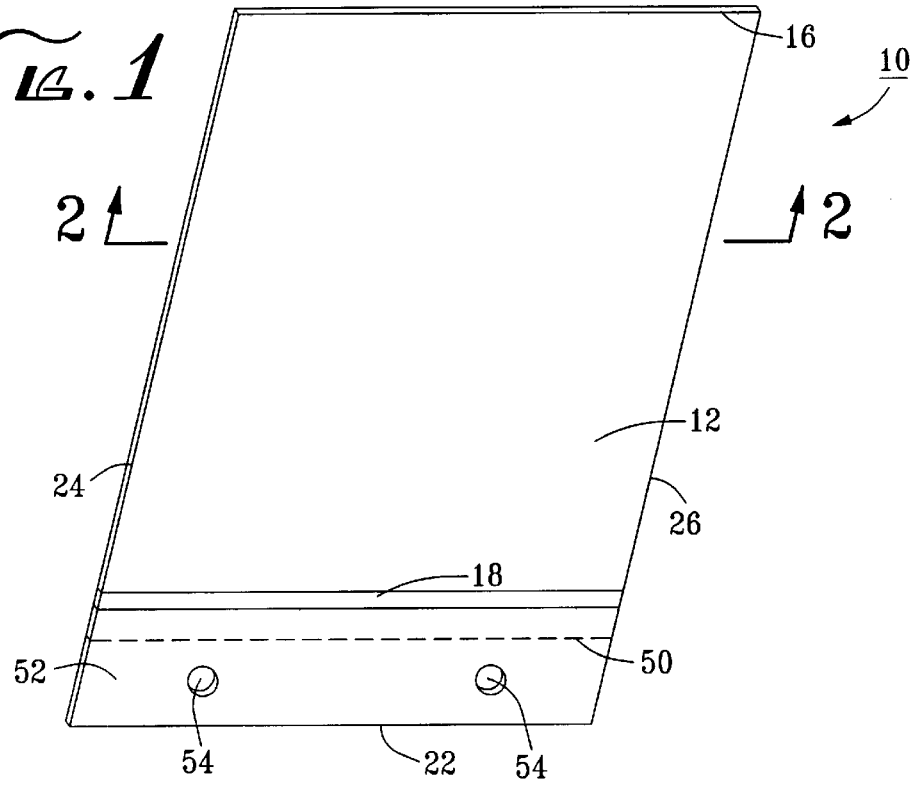
FIG. 1 is a perspective view of a plastic bag having features of the invention.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is plastic bag 10 comprising a front wall 12, a rear wall 14, a plastic top zipper 16 and a tongue-and-groove, one-time bottom edge sealing mechanism 18.

The front wall 12 and rear wall 14 are generally comprised of a flexible thermoplastic material, such as low density polyethylene, linear low density polyethylene or other similar flexible material known in the art to be useable in the construction of a plastic bag.

Figure 2:
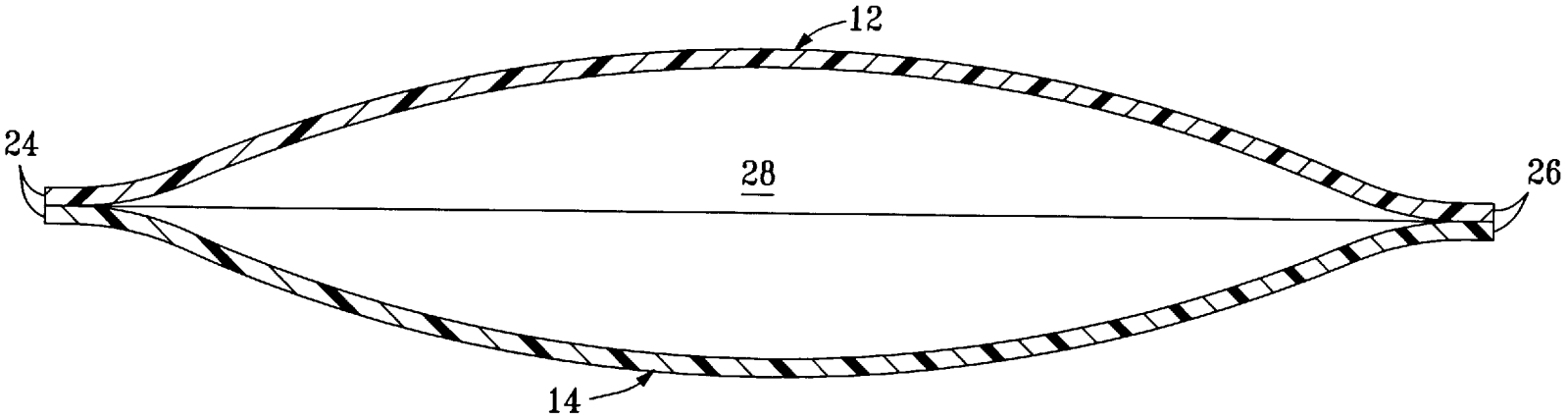
FIG. 2 is a cross-sectional view of the plastic bag of FIG. 1 taken along line 2—2.

As illustrated in FIGS. 1 and 2, both walls 12 and 14 have a top edge 20, a bottom edge 22, a first side edge 24 and an opposed second side edge 26. The first side edge 22 of the front wall 12 is attached to the first side edge 24 of the rear wall 14, and the second side edge 26 of the front wall 12 is attached to the second side edge 26 of the rear wall 14, so that the front wall 12 and the rear wall 14 are disposed opposite to one another and cooperate to define an interior bag compartment 28.

Disposed proximate to the top edges 20 of the front and rear walls 12 and 14 is the plastic top zipper 16 designed and constructed pursuant to techniques generally known in the art to allow the alternative and repeated sealing and unsealing of the top edges 20 of the front and rear walls 12 and 14. By "zipper," it is meant those plastic bag sealing devices generally known in the art having a longitudinal tongue disposed on one plastic edge sized and dimensioned to mate with an opposed longitudinal groove disposed on an opposing edge. The longitudinal tongue and the longitudinal groove are sized and dimensioned so that, when the tongue is disposed within the groove, an air-tight seal is provided, but the tongue can readily be removed from the groove without the use of special tools and later re-sealed, also without the use of special tools.

The one-time bottom edge sealing mechanism 18 comprises a first longitudinal groove 30 and a first longitudinal tongue 32. The first longitudinal groove 30 is disposed proximate to the bottom edge 22 of either the front wall 12 or the rear wall 14. The first longitudinal tongue 32 is disposed proximate to the bottom edge 22 of the wall 12 or 14 opposite the wall 12 or 14 having the first longitudinal groove 30. The first longitudinal tongue 32 is disposed, sized and dimensioned to mate with the first longitudinal groove 30, in such a way that the bottom edges 22 of the front and rear walls 12 and 14 can be permanently sealed.

It is not particularly important as to whether the rear wall 14 contains the first longitudinal groove 30 and the front wall 12 contains the first longitudinal tongue 32, or vice-versa. It is important only that one of the two walls 12 or 14 has the first longitudinal groove 30 and the opposite wall 12 or 14 has a corresponding first longitudinal tongue 32.

Typically, the first longitudinal tongue 32 has a preferably has a bulbous upper portion 34 and the first longitudinal groove 30 has a corresponding expanded lower portion 36, so that the first longitudinal tongue 32 fits snugly within the first longitudinal groove 30.

More preferably, the first longitudinal tongue 32 has at least one barb edge 37 extending along its length, and the first longitudinal groove 30 has at least one corresponding barb receiving space 38 so that, when the first longitudinal tongue 32 is disposed within the first longitudinal groove 30, the barb edge 37 on the first longitudinal tongue 32 mates with the barb receiving space 38 on the longitudinal groove 30, thereby preventing the first longitudinal tongue 32 from being removed from the first longitudinal groove 30.

In an even more preferred embodiment, the first longitudinal tongue 32 has two opposed barb edges 37 and the first longitudinal groove 30 has two corresponding opposed barb receiving spaces 38. Such a design provides increased assurance that the first longitudinal tongue 32 cannot be removed from the first longitudinal groove 30 once the first longitudinal tongue 32 is mated with the first longitudinal groove 30.

Figure 3:
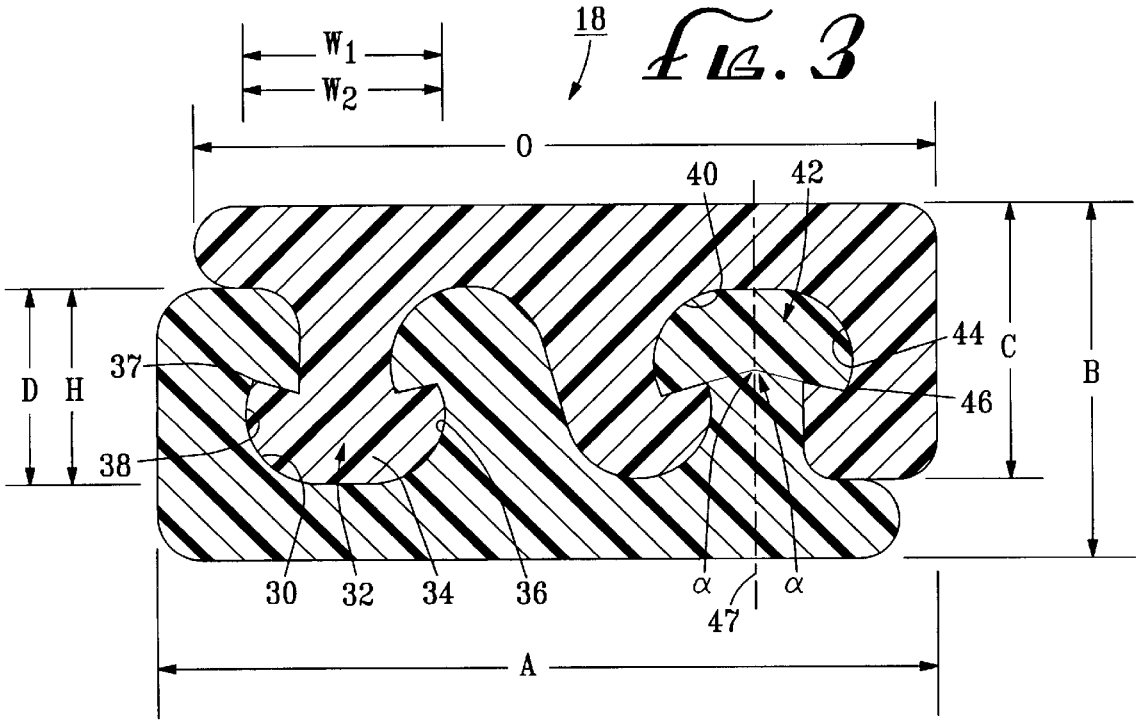
FIG. 3 is a cross-sectional detail view of a bottom edge sealing mechanism useable in the invention.

FIG. 3 illustrates a still more preferred embodiment of the invention wherein the plastic bag 10 further comprises a second longitudinal groove 40 disposed proximate to the bottom edge 22 of the wall 12 or 14 having the first longitudinal tongue 30 and disposed in parallel with the first longitudinal tongue 32, and a second longitudinal tongue 42 disposed proximate to the bottom edge 22 of the wall 12 or 14 having the first longitudinal groove 30 and disposed in parallel with the first longitudinal groove 30. The second longitudinal tongue 42 is disposed, sized and dimensioned to mate with the second longitudinal groove 42. Like the first longitudinal tongue 32 and first longitudinal groove 30, the second longitudinal tongue 42 preferably has at least one barb edge 44, more preferably a pair of opposed barb edges 44, disposed along its length, such barb edge 44 or edges 44 mates with a corresponding barb receiving space 46 (or spaces) disposed in the second longitudinal groove 40. This "double tongue-and-groove" design has been found to be extremely effective in creating a simple and inexpensive one-time sealing structure, useable for permanently sealing the bottom edges 22 of a plastic bag 10.

In a typical embodiment, the height H of the first longitudinal tongue 32 and the second longitudinal tongue 42 is about 0.134 mm, and the corresponding depth D of the first longitudinal groove and the second longitudinal groove is about 0.134 mm. It is further typical that the width $W_1$ of the bulbous upper portion 34 of the first longitudinal tongue 32 and the second longitudinal tongue 42 is about 0.134 mm and the width $W_2$ of corresponding expanded lower portion of the first longitudinal groove 30 and the second longitudinal groove 40 is about 0.136 mm. The length of the barb edges 37 are typically 0.034 mm and are preferably angled with respect to a longitudinal axis 47 of the first longitudinal tongue 32 and the second longitudinal tongue 42 by an angle $\propto$, which is less than about 90°, preferably, less than about 75°.

As illustrated in FIG. 3, the overall width A of the one-time bottom edge sealing mechanism 18 is typically about 0.543 mm, the overall thickness B is typically about 0.260 mm, the thickness of one side C is typically about 0.197 mm, and the width D of one side is typically about 0.465 mm.

As illustrated in FIG. 1, the top edges 20 of the plastic bag 10 of the invention are preferably one-time sealed in a way that they can be manually unsealed without tools. In the embodiment illustrated in FIG. 1, the top edges 20 are sealed along a first perforated line 48, such that the top edges 20 can be manually unsealed without tools by tearing the top edges 20 along the first perforated line 48.

Similarly, it is preferred that the bottom edges 22 be sealed in a way that they can be manually unsealed without tools, such as by being sealed along a second perforated line 50. Use of the second perforated line 50 allows the bottom edges 22 to be manually unsealed without tools by merely tearing the bottom edges along the second perforated line 50.

As illustrated in FIG. 1, the plastic bag 10 of the invention can conveniently further comprise a hanger strip 52 disposed below the second perforated line 50 so as to be abutting to the second perforated line 50. Such a hanger strip 52 typically has one or more holes 54 to allow the plastic bag 10 to be conveniently hung from a prong (not shown) and the plastic bag 10 conveniently removed from the hanger strip 52 by tearing along the second perforated line 50.

The plastic bag 10 of the invention has been found to provide a most convenient method of packaging fruits and vegetables, even in highly dusty environments, such as in the field. The user fills the plastic bag 10 with fruits or vegetables through the opening provided by the unsealed bottom edges 22. Once the bag 10 is filled, the lower edge one-time sealing mechanism 18 is permanently sealed by mating the longitudinal tongue 32 or tongues 32 and 42 with the corresponding longitudinal groove 30 or grooves 30 and 40. The bag 10 is thereby made ready for delivery to a retail establishment, where it can be (if desired) conveniently hung from one or more horizontal prongs disposed within the holes 54 in the hanger strip 52. The consumer can conveniently remove the bag 10 from the hanger strip 52 by tearing along the second perforated line 50.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A plastic bag comprising:

(a) a front wall and a rear wall, both walls being comprised of a flexible thermoplastic material and having a top edge, a bottom edge, a first side edge and an opposed second side edge, the first side edge of the front wall being attached to the first side edge of the rear wall and the second side edge of the front wall being attached to the second side edge of the rear wall so that the front wall and the rear wall are disposed opposite to one another and cooperate to define an interior bag compartment;

(b) a plastic top zipper disposed along the top edges of the front and rear walls so as to alternatively seal and unseal the top edges of the front and rear walls;

(c) a first longitudinal groove disposed proximate to the bottom edge of either the front wall or the rear wall, the first longitudinal groove being disposed so as to face the opposite wall; and (d) a first longitudinal tongue disposed proximate to the bottom edge of the wall opposite the wall having the longitudinal groove;

wherein the first longitudinal tongue has a bulbous upper portion and wherein the first longitudinal groove has an expanded lower portion so that the first longitudinal tongue fits snugly within the first longitudinal groove; and wherein the bulbous portion of the first longitudinal tongue has at least one barb edge and wherein the first longitudinal groove has at least one corresponding barb receiving space, so that, when the first longitudinal tongue is disposed within the first longitudinal groove, the barb edge on the first longitudinal tongue mates with the barb receiving space in the first longitudinal groove, thereby preventing the first longitudinal tongue from being removed from the first longitudinal groove;

whereby the bottom edges of the front and rear walls can be permanently sealed.

2. The plastic bag of claim 1 wherein the bulbous portion of the first longitudinal tongue has two opposed barb edges and wherein the first longitudinal groove has two corresponding opposed barb receiving spaces, so that, when the first longitudinal tongue is disposed within the first longitudinal groove, the barb edges on the first longitudinal tongue mate with the barb receiving spaces in the first longitudinal groove, thereby preventing the first longitudinal tongue from being removed from the first longitudinal groove.

3. The plastic bag of claim 1 wherein the top edges are sealed along a perforated line and the edges can be manually unsealed without tools by tearing the top edges along the perforated line.

4. The plastic bag of claim 1 wherein the bottom edges are sealed along a perforated line and the edges can be manually unsealed without tools by tearing the bottom edges along the-perforated line.

5. The plastic bag of claim 4 further comprising a hanger strip disposed above the perforated line and abutting the perforated line, the hanger strip having one or more holes to hang the plastic bag from a prong, the plastic bag being easily removed from the hanger strip by tearing along the perforated line.

6. The plastic bag of claim 1 further comprising:

(a) a second longitudinal groove disposed proximate to the bottom edge of the wall having the first longitudinal tongue and disposed in parallel with the first longitudinal tongue; and (b) a second longitudinal tongue disposed proximate to the bottom edge of the wall having the first longitudinal groove and disposed in parallel with the first longitudinal groove, the second longitudinal tongue being disposed, sized and dimensioned to mate with the second longitudinal groove.

7. The plastic bag of claim 6 wherein the second longitudinal tongue has a bulbous upper portion and where the second longitudinal groove has an expanded lower portion so that the second longitudinal tongue fits snugly within the second longitudinal groove.

8. The plastic bag of claim 7 wherein the bulbous portion of the second longitudinal tongue has at least one barb edge and wherein the second longitudinal groove has at least one corresponding barb receiving space, so that, when the second longitudinal tongue is disposed within the second longitudinal groove, the barb edge on the second longitudinal tongue mates with the barb receiving space in the second longitudinal groove, thereby preventing the second longitudinal tongue from being removed from the second longitudinal groove.

9. The plastic bag of claim 7 wherein the bulbous portion of the second longitudinal tongue has two opposed barb edges and wherein the second longitudinal groove has two corresponding opposed barb receiving spaces, so that, when the second longitudinal tongue is disposed within the second longitudinal groove, the barb edges on the second longitudinal tongue mate with the barb receiving spaces in the second longitudinal groove, thereby preventing the second longitudinal tongue from being removed from the second longitudinal groove.

10. A plastic bag comprising:

(a ) a front wall and a rear wall, both wall being comprised of a flexible thermoplastic material and having a top edge, a bottom edge, a first side edge and an opposed second side edge, the first side edge of the front wall being attached to the first side edge of the rear wall and the second side edge of the front wall being attached to the second side edge of the rear wall so that the front wall and the rear wall are disposed opposite to one another and cooperate to define an interior bag compartment;

(b) a plastic top zipper disposed along the top edges of the front and rear walls so as to alternatively seal and unseal the top edges of the front and rear walls;

(c) a first longitudinal groove disposed proximate to the bottom edge of either the front wall or the rear wall, the first longitudinal groove being disposed so as to face the opposite wall;

(d) a first longitudinal tongue disposed proximate to the bottom edge of the wall opposite the wall having the first longitudinal groove;

(e) a first perforated line sealing the top edges of the front wall and rear wall so as to seal the top opening in a way in which the seal can be manually broken without tools by tearing along the first perforated line; and (f) a second perforated line sealing the bottom edges of the front and rear walls such that the seal can be manually broken without tools by tearing along the second perforated line;

wherein the first longitudinal tongue has a bulbous upper portion and wherein the first longitudinal groove has an expanded lower portion so that the first longitudinal tongue fits snugly within the first longitudinal groove; and wherein the bulbous portion of the first longitudinal tongue has at least one barb edge and wherein the first longitudinal groove has at least one corresponding barb receiving space, so that, when the first longitudinal tongue is disposed within the first longitudinal groove, the barb edge on the first longitudinal tongue mates with the barb receiving space in the first longitudinal groove, thereby preventing the first longitudinal tongue from being removed from the first longitudinal groove;

whereby the bottom edges of the front and rear walls can be permanently sealed.

11. The plastic bag of claim 10 further comprising:

(a) a second d longitudinal groove disposed proximate to the bottom edge of the wall having the first longitudinal tongue and disposed in parallel with the first longitudinal tongue; and (b) a second longitudinal tongue disposed proximate to the bottom edge of the wall having the first longitudinal groove and disposed in parallel with the first longitudinal groove, the second longitudinal tongue being disposed, sized and dimensioned to mate with the second longitudinal groove;

wherein the second longitudinal tongue has a bulbous upper portion and wherein the second longitudinal groove has an expanded lower portion so that the second longitudinal tongue fits snugly within the second longitudinal groove; and wherein the bulbous portion of the second longitudinal tongue has at least one barb edge and wherein the second longitudinal groove has at least one corresponding barb receiving space, so that, when the second longitudinal tongue is disposed within the second longitudinal groove, the barb edge on the second longitudinal tongue mates with the barb receiving space in the second longitudinal groove, thereby preventing the second longitudinal tongue from being removed from the second longitudinal groove.

* * * * *